United States Patent [19]

Fields

[11] Patent Number: 4,746,158

[45] Date of Patent: May 24, 1988

[54] SECONDARY-SIDE TUBE GRIPPER

[75] Inventor: Kevin L. Fields, Chambersburg, Pa.

[73] Assignee: Westinghouse Electric Corp., Pittsburgh, Pa.

[21] Appl. No.: 912,690

[22] Filed: Sep. 29, 1986

Related U.S. Application Data

[63] Continuation of Ser. No. 631,351, Jul. 16, 1984, abandoned.

[51] Int. Cl.[4] ..... B25B 1/00; B66C 1/00

[52] U.S. Cl. ..... 294/94; 29/157.3 R; 29/426.5; 29/726; 29/280; 294/82.25

[58] Field of Search ..... 29/157.3 R, 157.3 A, 29/157.3 AH, 157.3 V, 157.3 B, 257.3 C, 726, 262, 263, 426.5, 258, 280, 278; 294/27 R, 33, 31 R, 83 R, 86.25, 86.28, 94, 96

[56] References Cited

U.S. PATENT DOCUMENTS

| | | | |
|---|---|---|---|
| 29,715 | 8/1860 | Perry | 29/726 |
| 819,516 | 5/1906 | Chamberlain | 29/726 |
| 1,489,705 | 4/1924 | Leonard | 294/86.25 X |
| 1,694,953 | 12/1928 | Smoot | 294/86.25 |
| 2,497,633 | 2/1950 | Shapiro et al. | 29/280 X |
| 2,594,429 | 4/1952 | Handley | 294/96 |
| 2,618,053 | 11/1952 | Claps | 29/263 |
| 2,694,603 | 11/1954 | Griffin | 29/278 X |
| 2,834,625 | 5/1958 | Stanley et al. . | |
| 2,939,739 | 6/1960 | Grunsky | 294/96 |
| 3,057,631 | 10/1962 | La Fleur | 29/282 X |
| 3,367,011 | 2/1968 | Sipher | 29/280 X |
| 3,485,388 | 12/1969 | Bohne . | |
| 3,507,028 | 4/1970 | Stellatella | 29/252 X |
| 3,709,546 | 1/1973 | Vaughan | 294/96 |
| 3,758,146 | 9/1973 | Kaercher, Jr. . | |
| 3,791,011 | 2/1974 | Keys | 29/252 |
| 4,000,556 | 1/1977 | Ciminero | 29/427 |
| 4,044,444 | 8/1977 | Harris | 29/727 |
| 4,106,177 | 8/1978 | Beard | 29/427 |
| 4,180,903 | 1/1980 | Hannigan, Jr. | 29/727 |
| 4,213,239 | 7/1980 | Filer | 29/726 |
| 4,214,362 | 7/1980 | Beard | 29/726 |
| 4,280,274 | 7/1981 | Filer | 29/726 |
| 4,283,826 | 8/1981 | Miller | 29/157.3 C X |
| 4,292,731 | 10/1981 | Filer | 29/726 |
| 4,312,124 | 1/1982 | Calhoun | 29/726 |
| 4,355,450 | 10/1982 | Miller | 29/426.5 |
| 4,369,569 | 1/1983 | Armstrong, Jr. et al. | 29/726 |

FOREIGN PATENT DOCUMENTS

| | | | |
|---|---|---|---|
| 495040 | 8/1950 | Belgium | 294/96 |
| 0029745 | 6/1981 | European Pat. Off. . | |
| 403230 | 6/1966 | Switzerland . | |
| 329203 | 5/1930 | United Kingdom . | |
| 712195 | 7/1954 | United Kingdom . | |
| 1245579 | 9/1971 | United Kingdom . | |
| 2127732A | 4/1984 | United Kingdom . | |

OTHER PUBLICATIONS

U.S. Patent Application Ser. No. 584,225, filed Feb. 27, 1984, by Calhoun et al., entitled "Double-Grip Tube Puller".

*Primary Examiner*—Charlie T. Moon

[57] ABSTRACT

A gravity-operated tube gripper and puller actuated by a rotatably-operated latch is disclosed herein. The gripper includes a gripping means having a collet assembly with a threaded collet which is expandable by means of a frustro-conical body. The gripper further includes a suspension member connected to the frustro-conical body, and detachably connected to the expandable collet. The rotatably-operated latch of the gripper selectively disconnects the collet assembly, so that the weight of the frustro-conical body engages the mouth of the expandable collet, and expands the threaded exterior of the collet into the inner walls of the tube. The invention provides a tube gripper which is easily manually operated through a simple extension rod. It is particularly useful in removing sample tubes from areas of limited accessibility in the secondary sides of nuclear steam generators.

20 Claims, 2 Drawing Sheets

37
38a
38b
35
36
50
48

59
61a
61b
55
57

42
44
46
25
23
21a
13
6
15
17
9
19a
11

33
31
27
29

75
77a
77b
71
73

SECONDARY-SIDE TUBE GRIPPER

This application is a continuation, of application Ser. No. 631,351 filed July 16, 1984, now abandoned.

BACKGROUND OF THE INVENTION

1. Field of the Invention

This invention relates to a gripper for gripping and removing tubes from tube bundles. It is particularly useful in removing sample heat-exchanger tubes from the secondary side of a nuclear steam generator.

2. Description of the Prior Art

Tube grippers for gripping and pulling tubes out of the tube bundles of heat exchangers are known in the prior art. Typically, such tube grippers include an expandable collet having a plurality of gripping threads which is insertable into the mouth of the tube to be pulled. The actuator mechanism of such grippers is usually a tapered expander member which may be forcefully engaged into the mouth of the expandable collet. The tapered expander member is connected to a rod which is slidably engaged through the mouth of the collet through a centrally disposed bore in the collet. When a tensile force is applied to the rod, the tapered expander member is drawn up into the mouth of the collet. The wedging forces that the tapered expander member applies to the mouth of the collet spreads the walls of the collet outwardly so that its outside threads grippingly engage the inner walls of the tube. After the tube has been gripped, a hydraulic ram or other pulling means applies a tensile force to the entire gripper in order to pull the tube out of its respective tube bundle.

In some of these prior art mechanisms, the tensile force applied by the hydraulic ram is used both to spread the walls of the expandable collet into gripping contact with the inner walls of the tube, as well as to withdraw the tube from the tube bundle. However, such mechanisms require some sort of collet-retaining mechanism, such as an arrangement of hydraulically-operated, telescoping sleeves, to simultaneously push the expandable collet into the mouth of the tube while the tensile force pulls on the tapered expander member; otherwise, the tensile force applied by the hydraulic ram would merely pull the expandable collet out of the mouth of the tube instead of expanding the collet into gripping engagement with the inner walls of the tube.

While such prior art tube grippers provide good results when the mouth of the tube is in a freely accessible location (such as the tubesheet in the primary side of a nuclear steam generator), such grippers are difficult to use in areas where the mouth of the tube is in a less accessible location, such as the secondary side of a nuclear steam generator. To fully appreciate the difficulties associated with using such prior art tube grippers in the secondary side of such a generator, some general background is necessary concerning both the structure and maintenance procedures associated with nuclear steam generators.

Nuclear steam generators generally include a primary side through which hot, radioactive water from the reactor core is admitted into a plurality of heat exchange tubes which may be U-shaped. Such generators further include a secondary side which houses and spaces these tubes and circulates a flow of non-radioactive water therethrough so that non-radioactive steam may be generated from the energy output of the reactor core. The tubes in the secondary side are densely arranged in a tube bundle. The tubes of the steam generator transfer heat from the radioactive water flowing through their inside surfaces to the non-radioactive water flowing over their outside surfaces. To facilitate this heat transfer, a plurality of horizontally disposed baffle plates and support plates are mounted throughout the secondary side of the steam generator in order to uniformly space the heat-exchanging tubes from one another. Each of these plates includes a plurality of uniformly-spaced openings (which may be bores) through which the tubes extend. The openings of the plates are arranged in registry with one another in order that the legs of the U-shaped heat-exchange tubes may be arranged parallel to one another.

Over a period of time, corrosive sludge deposits may accumulate around the legs of the heat exchange tubes in the sections of these tubes which are surrounded by the tubesheet which separates the primary side of the steam generator from the secondary side, and the bores of the support plates, which are located in the secondary side of the steam generator. In order to determine the extent to which these sludge deposits attack the walls of the heat exchange tubes in these areas, samples of these tubes must be periodically cut and withdrawn either through the primary side of the generator from the tubesheet, or from the secondary side of the generator.

When the sample tube is taken from the primary side of the generator through the tubesheet, the mouth of the tube is freely accessible since it is flush against the side of the tubesheet which faces the primary side of the generator. However, the mouths of such sample tubes in the secondary side of the generator are not nearly as accessible. In taking such secondary-side samples, it is first necessary to cut the greater part of the bight portion of the U-shaped tube being sampled, thereby opening the upper ends of the two legs of the U-shaped tube. Each of the legs is then cut again with an inner-diameter tube cutter in order to free it from the tubesheet. Unfortunately, the upper, open ends of these sample tubes are thickly surrounded by the bight portions of the other U-shaped tubes which are not being sampled. If one attempts to use a prior art tube gripper to grip and pull one of these sample tubes, two problems immediately arise. First, the bulkiness and size of the collet-retaining mechanism may make it impossible to position the gripper deep inside the tube bundle between the thickly arranged heat exchange tubes so that the expandable collet is properly positioned inside the mouth of the sample tube. Even if the tube gripper is sufficiently small in cross-sectional area so it may be inserted between these adjacent tubes, it is almost always necessary to use some sort of extension mechanism to position the gripper and to connect it to the hydraulic ram. However, when this is done, proper and reliable actuation of the expanding member becomes the second problem. As previously mentioned, the proper actuation of prior art grippers requires some sort of mechanism for simultaneously applying a collet-retaining force while a tensile force is applied to the tapered expanding member in order to draw it up into engagement with the expanding collet. An extension mechanism which incorporates such a collet-retaining mechanism (like the previously mentioned pair of telescoping sleeves, or a rod and cylinder arrangement) is difficult and expensive to machine, and difficult and time-consuming to operate. Additionally, such a design does not provide an extension mechanism which is easily length-adjustable (i.e., easily built in segments until the desired length is obtained).

Accordingly, there is a need for a tube gripper which may be easily inserted into a sample tube in a crowded tube bundle and operated by means of a simple, rod-like extension which may be conveniently adjusted to a desired length. Further, it would be desirable if the gripper itself were simple in structure, reliable in operation, and capable of quickly gripping and pulling sample tubes from a nuclear steam generator so that the time spent by maintenance personnel in the radioactive environment of the nuclear steam generator is minimal.

SUMMARY OF THE INVENTION

In its broadest sense, the invention is a tube gripper for gripping the inner walls of a tube which may be actuated by a rotatably-operated latch. Generally, the tube gripper comprises a gripping means including a collet assembly, an expander for expanding and engaging an expandable collet on this assembly, and a rotatably-operated latch for selectively releasing an engaging force between the expander and the collet. When the gripping means is inserted into the upper open end of a substantially vertically oriented tube, the weight of the collet assembly may supply the engaging force between the expander and the collet. The tube gripper may further include a suspension member connected to the expander and detachably connected to the collet assembly for suspending the collet over the expander, and the rotatably-operated latch may operate to selectively disconnect the collet assembly from the suspension member so that the weight of the collet assembly causes the collet to engage the expander and spread out into gripping contact with the inner walls of the tube to be pulled.

The use of a rotatably-operated latch to selectively actuate a relatively simple, gravity-operated tube gripper provides a gripper which is particularly useful for gripping and removing tube samples from the tube bundle on the secondary side of a nuclear steam generator, in that the gripper may be easily positioned and operated inside the crowded tube bundle by means of a simple extension rod.

The rotatably-operated latch of the invention may include a latch hook having a pin-receiving notch for receiving a latch pin mounted on the aforementioned suspension member. The expandable collet of the invention may be an integral part of a collet assembly which includes the mouth of the expandable collet on one end, and a stop collar on the other end for limiting the extent to which the expandable collet may be inserted into the mouth of a tube.

Finally, the gripper of the invention may include an extension rod which may be conveniently attached onto the suspension member of the gripping means. The extension rod may be formed from a plurality of detachably-connectable extension members of different lengths in order that the length of the extension rod may be conveniently adjusted.

BRIEF DESCRIPTION OF THE SEVERAL FIGURES

Figures 4A, 5, 6, 7, 8:
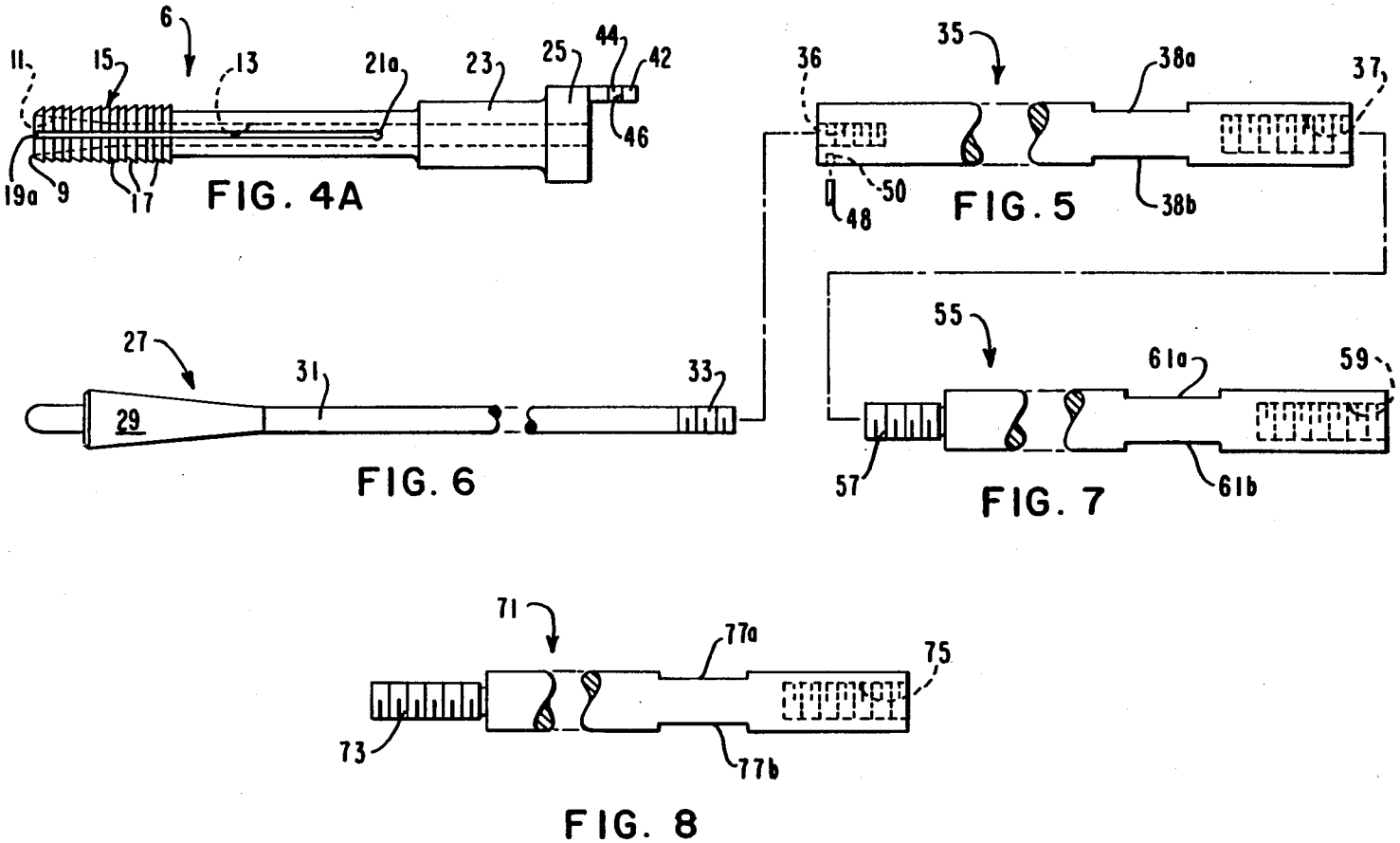
FIG. 4A is a side view of the collet assembly of the gripper.

FIGS. 5, 6 and 7 constitute an exploded side view of the tube gripper of the invention, which illustrates the assembly of the collet expander, suspension member and extension adapter of the invention, and FIG. 8 is a side view of an extension member which may be used in the invention.

DETAILED DESCRIPTION OF THE PREFERRED EMBODIMENT

Figure 1:
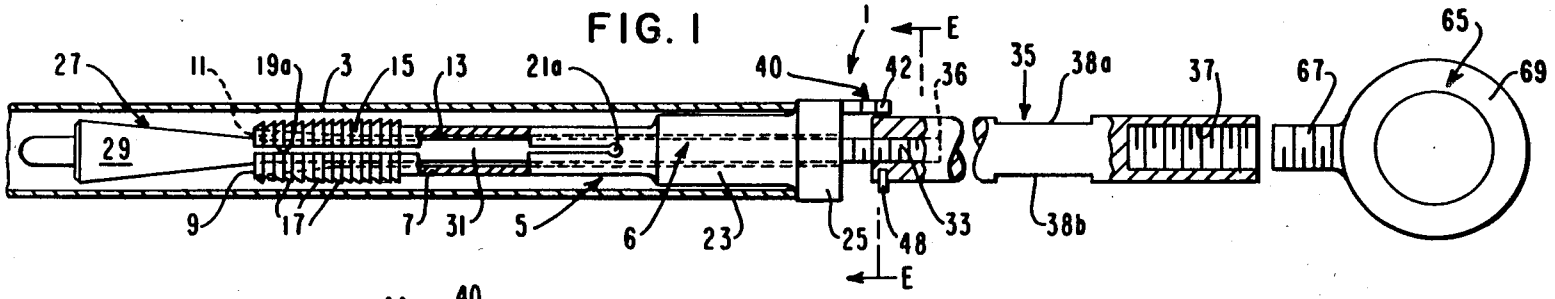
FIG. 1 is a partial, cross-sectional side view of the tube gripper invention as it appears inserted in the open end of a tube.
Figure 2:
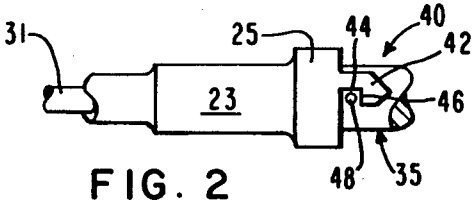
FIG. 2 is a side view of the rotatably-operated latch of this tube gripper.

With reference now to FIGS. 1 and 2, wherein like numerals designate like components, the tube gripper 1 of the invention generally comprises a gripping means 5 including a collet assembly 6, a collet expander 27, and a suspension member 35. The suspension member 35 is connected to the collet expander 27 and detachably connected to the collet assembly 6 by means of a rotatably-operated latch 40. The latch 40 is formed by a latch hook 42 and a latch pin 48. As will be explained in more detail hereinafter, the gripping means 5 and the suspension member 35 may be manually rotated relative to one another so that the latch hook 42 located on the collet assembly 6 is disconnected from the latch pin 48 located on the suspension member 35. When this occurs, the weight of the collet assembly 6 causes the frustro-conical body 29 to engage and expand the expandable collet 7 when the expander 27 is drawn through the collet assembly 6, thereby bringing the threads 17 of the collet 7 into gripping engagement with the inner walls of the tube 3.

Figure 4C:
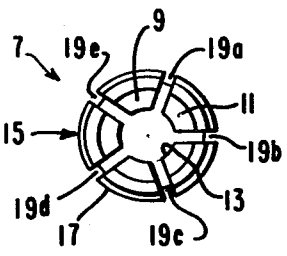
FIG. 4C is a front view of this expandable collet.
Figure 4E:
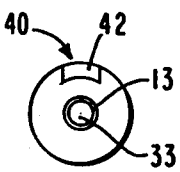
FIG. 4E is a cross-sectional view of the collet assembly, taken along line E—E of FIG. 1.
Figure 4D:
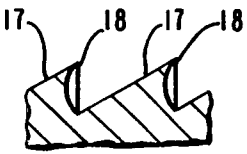
FIG. 4D is an enlarged, cross-sectional view of the barbed threads used in the expandable collet of the invention.
Figure 4B:
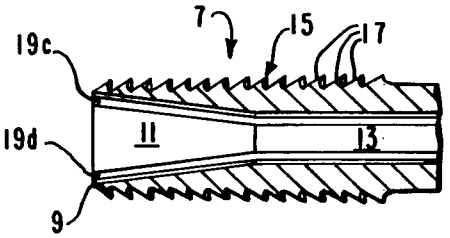
FIG. 4B is a cross-sectional view of the expandable collet of the collet assembly illustrated in FIG. 4A.

With specific reference now to FIGS. 2 and 4A through 4E, the collet assembly 6 of the gripper 1 includes an expandable collet 7 having an open mouth 9 at its distal end, and a collet base 23 which terminates in a stop collar 25 at its proximal end. The interior of the expandable collet 7 of the collet assembly 6 includes a frustro-conical cavity 11 which terminates in its distal end in the open mouth 9 of the collet 7. Cavity 11 is generally complementary in shape to the frustro-conical body 29 of the collet expander 27. As is best seen with reference to FIG. 4B, the proximal end of the frustro-conical cavity 11 joins a cylindrical bore 13 which extends the entire length of the collet assembly 6. Turning now to the outside of the collet assembly 6, the exterior of the expandable collet 7 includes a plurality of tube gripping threads 17, as indicated. As is best seen in FIG. 4D, each of the threads 17 terminates in a barbed point 18. For any given engagement pressure, the barbed profile of the threads 17 grips the inside walls of the tube 3 better than threads having a conventional triangular profile, because the sharp edges of the barbed profile allow the tips 18 of the threads 17 to more easily penetrate the inner walls of the tube 3. Such a superior, initial penetration of the points 18 of the threads 17 into the inner walls of the tube 3 is particularly important in the invention as a safeguard against slippage, since the principal collet-expanding force is not applied until a tube-pulling force is applied to the proximal end of the gripper 1. In the preferred embodiment, the threads 17 are coated with Armalloy® in order to bring their Rockwell hardness up to about 70, so that they might easily penetrate the Inconel walls of the tube 3. Additionally, the threads 17 spiral around the body of the collet 7 in a left-handed configuration in order to facilitate the removal of the expanded collet 7 from the inner walls of the tube 3, as will be explained in detail hereinafter.

To provide the mechanical flexibility that the expandable collet 7 must have in order to effectively execute the gripping operation, the walls of the collet 7 includes a plurality of longitudinal slots 19*a*, 19*b*, 19*c*, 19*d* and 19*e*. As is best seen in FIG. 4C, these slots are preferably equidistantly arranged around the circumference of the expandable collet 7. These slots have the effect of dividing the expandable collet 7 into a plurality of resilient "fingers". Although it is not evident in any of the several figures, the resilient fingers that form the expandable collet 7 each taper slightly inwardly in their unexpanded state, so that they will assume a substantially cylindrical configuration when the frustro-conical body 29 of the collet expander 27 is withdrawn into the frustro-conical cavity 11 of the collet 7. In this way, each of the threads 17 of the gripping means will engage the inner walls of the tube 3 during the gripping operation. As may best be seen in FIG. 4A, each of these longitudinal slots 19*a*, 19*b*, 19*c*, 19*d* and 19*e* terminates in a stress-relieving keyhole 21*a* and other keyholes not shown in the drawing, respectively (of which only keyhole 21 is visible). These keyholes effectively dissipate the stress concentrated at the termination points of the aforementioned longitudinal slots when the frustro-conical body 29 of the collet expander 27 is withdrawn into the complementary, frustro-conical cavity 11 of the expandable collet 7.

As previously mentioned, the proximal end of the collet assembly 6 includes a collet base 23 and a stop collar 25. The end of the expandable collet 7 preferably melds into the front face of the collet base 23 by means of an arcuate shoulder, as indicated, in order that the joint between the collet 7 and the base 23 will not hang up on the edge of the mouth of a tube 3 when the operator inserts the gripper 1 inside the open end of a tube 3 in the position illustrated in FIG. 1. The collet base 23 serves two functions. First, the cylindrical shape of the base 23 concentrically positions the threaded exterior 15 of the expandable collet 7 with respect to the inner walls of the tube 3 when the gripping means 5 of the gripper 1 is inserted into the open mouth of the tube 3. Second, the collet base 23 lends the weight that the collet assembly 6 must have if the frustro-conical body 29 of the collet expander 27 is to engage and expand the collet 7 during the tube gripping operation. The proximal end of the collet assembly 6 terminates in a stop collar 25. Stop collar 25 serves the important function of limiting the extent to which the expandable collet 7 may be inserted along the longitudinal axis of the tube 3. Stop collar 25 also seats the gripping means 5 on the open end of the tube 3 so that the weight of the collet assembly 5 is borne by the tube 3 during the gripping operation. Although the stop collar 25 is integrally formed with the collet base 23 in the preferred embodiment, it should be noted that, in an alternate embodiment, an adjustable stop collar formed by a ring and set-screw arrangement could be fitted over the collet base 23. Such an alternate arrangement would advantageously afford a means to longitudinally adjust the extent to which the expandable collet 7 is inserted along the longitudinal axis of the tube 3 prior to the tube gripping operation. It should be noted that a sleeve could be used in lieu of such a ring if a very shallow penetration into the open end of the tube 3 were desired. In the preferred embodiment, collet assembly 6 is formed from Vascomax® 300VM tool steel, and has a sufficiently small diameter so that the gripper 1 may easily be slid through the bores in the support plates in a nuclear steam generator. Such dimensioning allows the gripper 1 to grip and pull sample tubes which are located beneath the support plates in the secondary side of a steam generator.

The collet expander 27 includes a frustro-conical body 29 at its distal end, and a rod 31 which terminates in a threaded end portion 33 located at its proximal end. The rod 31 of the expander 27 slidably extends through the centrally disposed, cylindrical bore 13 present in the collet assembly 6. If the gripper 1 is to operate properly, the rod 31 of the collet expander 27 must be able to freely slide through the bore 13 without binding. Like collet assembly 6, collet expander 27 is likewise preferably formed from Vascomax® 300VM tool steel. Although not shown in any of the several Figures, the distal end of the frustro-conical body 29 may include a circumferential flange for limiting the extent to which the body 29 may be inserted into the complementary frustro-conical cavity 11 inside collet 7. Such a limiting flange is desirable when one wishes to limit the amount of radial gripping force that the body 29 is capable of asserting against the fingers of the expandable collet 7. Such a limitation on this radial gripping force might be desirable when one is pulling severely corroded sample tubes whose walls are apt to split from the resulting radial pressure.

Figure 3B:
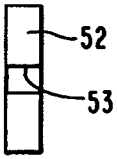
FIGS. 3A and 3B are a plan view and a side view, respectively, of a puller puck used to couple the tube gripper of the invention onto a hydraulic ram.
Figure 3A:
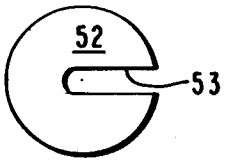

With specific reference now to FIGS. 1, 5 and 6, the preferred embodiment of the gripper 1 further includes a suspension member 35 which includes a threaded bore 36 for receiving the threaded end portion 33 of the rod 31 of the collet expander 27. In its central portion, the suspension member 35 includes a pair of parallel, flat surfaces 38*a*, 38*b* which may be received within the slot 53 of the puck 52 illustrated in FIGS. 3A and 3B in order that this portion of the gripper 1 may be coupled onto a hydraulic ram. Finally, at its proximal end, the suspension member 35 preferably includes another threaded bore 37 for receiving the male threads 57 of an extension member 55.

With reference now to FIGS. 1, 2, 4A and 5, the tube gripper 1 of the invention also includes a rotatably-operated latch assembly 40 for detachably connecting the collet assembly 6 to the suspension member 35. This latch assembly 40 includes a latch hook 42 which is preferably integrally formed with the stop collar 25 located at the proximal end of the collet assembly 6, as well as a latch pin 48 receivable within a bore 50 located at the distal end of the suspension member 35. The pin is engageable within a pin-receiving notch 44 present in the latch hook 42. The pin-receiving notch 44 includes an upper edge 46 which is preferably slightly arcuate in shape, so that the pin 48 will remain captured within the notch 44 as long as the weight of the collet assembly 6 applies a tensile load between the collet assembly 6 and the suspension member 35. However, as soon as this tensile load is removed by, for example, seating the stop collar 25 against the open end of the tube 3, the pin 48 may easily be disengaged from the notch 44 by merely manually twisting the suspension member 35 a few degrees counterclockwise.

FIG. 7 illustrates the extension adapter 55 of the gripper 1 of the invention. Adapter 55 includes a threaded male portion 57 at its proximal end which may be threadably engaged into the threaded bore 37 of the suspension member 35. Like the suspension member 35, the central portion of the extension adapter includes a pair of parallel, flat surfaces 61*a*, 61*b* which are receivable within the slot 53 of the puck 52, as well as a right-handed threaded bore 59 at its proximal end.

Finally, the tube gripper 1 includes an extension means formed from one or more extension segments 71, an example of which is illustrated in FIG. 8. Each of the extension segments 71 includes a right-handed male thread 73 at its distal end, and a right-handed female thread 75 at its proximal end. Additionally, each of the extension segments 71 includes a pair of flat, parallel surfaces 77*a*, 77*b* which are receivable within the aforementioned slot 53 of the puck 52 used to couple the gripper 1 to a hydraulic ram. After the male thread 73 of the first extension segment 71 is screwed into the threaded bore 59 of the extension adapter 55, any number of these extension segments 71 may be screwed together in tandem to create an extension means of any desired length. In the preferred embodiment, each of the extension segments 71 is formed from No. 304 stainless steel, as is the extension adapter 55 and suspension member 35. In order that the segment 71 might create an extension means of a desire length with a minimum number of screw joints, the segments 71 are preferably formed in a variety of lengths ranging between 1 m. and 15 cm. To facilitate retrieval in the event that the gripper 1 is inadvertently dropped in a tube bundle, an eyelet 65 having a threaded male portion 67 and a ring 69 is screwed into the threaded bore 75 of the last extension segment 71. The ring 69 of the eyelet 65 (which is illustrated in FIG. 1) may be easily hooked and hoisted by a lanyard if the gripper 1 falls into the tube bundle by mistake.

In operation, an extension means of a desired length is constructed by screwing together in tandem a plurality of extension segments 71, as heretofore described. Preferably, the larger extension segments 71 of 1 m. in length are first screwed together until an extension means of nearly the desired length is obtained. Thereafter, 15 cm. extension segments 71 are used to complete the extension means, so that the resulting extension is formed with a minimum number of screw joints.

Next, the male threads 73 of the first extension segment 71 are screwed into the threaded bore 59 of the extension adapter 55. The tube gripper 1 is then manually oriented into a vertical position with the collet 7 pointing down and the latch pin 48 captured within the pin-receiving notch 44 of the rotatable latch assembly 40.

The collet assembly 6 of the gripping means 5 is next lowered down from above inserted into the upper opened end of the tube 3 which is substantially vertically oriented until the stop collar 25 of the collet assembly 6 seats itself around the edge of the open end of the tube 3. The operator of the gripper will know such seating has occurred from the solid feeling of engagement the extension means will transmit to his hands when the stop collar 25 strikes the open end of the tube 3. When this occurs, the tube 3 bears the entire weight of the collet assembly 6. There is therefore no longer any tensile load between the latch pin 48 connected to the suspension member 35, and the arcuate, upper edge 46 of the notch 44 of the latch hook 42. The pin 48 may therefore be easily disengaged from the pin-receiving notch 44 by manually twisting the suspension member 35 via the extension means formed from the segment 71 a few degrees counterclockwise.

If the tube 3 is sufficiently loose, it may then be pulled out by hand. However, if the tube is not loose, a hydraulic ram must next be used. In such a case, the puck 52 is next engaged to the extension means of the gripper 1 in order to couple the ram to the gripper 1. A hydraulic ram of conventional structure is next coupled onto the puck 52. In the preferred embodiment, the hydraulic ram is mounted on a table capable of being slid along both the x and y axes on the plane above the tube bundle. Such a sliding table mounting allows the operator to easily slide the ram into a proper coupling position relative to the extension means after the gripper has been manually inserted into the open end of the sample tube 3 to be pulled. The ram is then actuated in order to apply a tensile force onto the proximal end of the gripper 1. This tensile force withdraws the frustro-conical body 29 of the collet expander 27 into the mouth 9 of the expandable collet 7. Both the flexibility of the walls of the expandable collet 7, and the overall weight of the collet assembly 6, are chosen so that the barbed threads 17 on the outer surface of the collet 7 engage the inner walls of the tube 3 before the tensile force transmitted by the collet expander 27 counteracts the weight of the collet assembly 6. Since the gripping operation in the secondary sides of most nuclear steam generators takes place underwater, the weight of the collet assembly 6 should be chosen so that the collet 7 is expanded, despite the weight-lightening effect that buoyancy will exert on the collet assembly 6. After the frustro-conical body 29 of the collet exapnder 27 is withdrawn into the mouth 9 of the collet 7, the more tensile force the hydraulic ram applies to the tube gripper 1, the more tightly the barbed threads 17 of the expandable collet 7 engage the inner walls of the tube 3. The tube 3 is then withdrawn from the secondary side of the steam generator.

It should be noted that, in a slightly modified form, the gripper could be made to operate without the necessity of the stop collar 25 of the collet assembly 6 seating itself around the edge of the open end of the tube 3. Specifically, if the upper edge 46 of the notch 44 of the latch hook 42 were made straight, instead of arcuate, the gripper 1 could be made to operate by merely inserting the expandable collet 7 into the open end of the tube 3, and rapidly twisting the extension means of the gripper so that the pin 48 becomes disengaged from the notch 44 by virtue of the rotational inertia of the collet assembly 6. Gravity would then cause the collet assembly 6 to freely slide along the rod 31 of the expander 27 until the frustro-conical body 29 forcefully engaged the mouth 9 of the exapndable collet 7, thereby expanding the collet 7 into gripping engagement with the inner walls of the tube 3.

In order to release the expandable collet 7 from the inner walls of the tube 3, the operator of the gripper 1 merely removes the extension means and the extension adapter 55, and exerts a short, firm, compressive force onto the suspension member 35. Such a compressive force dislodges the frustro-conical body 29 out of the frustro-conical interior 11 of the expandable collet 7, which in turn causes the resilient fingers of the collet 7 formed by the slots 19*a*, 19*b*, etc., to flex inwardly, thereby releasing the collet assembly 6 from the inner walls of the tube 3. The suspension member 35 is then pushed toward the open end of the tube 3 and rotated clockwise a few degrees in order to recapture the latch pin 48 into the pin-receiving notch 44 of the latch hook 42. It is at this point in the process that the provision of a left-handed pitch onto the threads 17 may be appreciated. As the operator twists the suspension member 35 in a clockwise direction to reconnect the latch assembly 40, the left-handed pitch on the threads 17 causes them to move slightly forward along the inner walls of the tube 3. Such a forward movement of the threads 17 causes them to flex inwardly, and to disengage their barbed points 18 from the inner walls of the tube 3.

What is claimed is:

1. A gravity operated tube gripper for gripping the inner walls of a single, substantially vertically oriented tube located within a densely packed array of tubes when said gripper is lowered into an upper open end of said tube from a position above said tube, comprising:

(a) a gripping means including a collet assembly having an expandable collet at one end which is insertable within a tube, and a collet expander for selectively engaging and expanding said expandable collet;

(b) a suspension member having a distal end, and a proximal end that is connected to said expander and detachably connected to said collet assembly for suspending said collet assembly over said expander, and for transmitting a torsional force to said expander, and (c) a stop collar on the end of said collet assembly opposite said expandable collar for seating said collet assembly on the open end of the tube so that the stop collar bears the weight of said collet assembly;

(d) a latch means which is rotatably and remotely operable only by rotating the distal end of the suspension member when the stop collar bears the weight of the collet assembly on the open end of the tube in order to transmit a torsional force to said expander for selectively detaching said collet assembly from said suspension member so that gravity causes said expandable collet to forcefully engage said expander and expand said expandable collet into gripping contact with the inner walls of said tube, wherein the maximum cross sectional area of said tube gripper is only slightly in excess of the outer diameter of said tube to facilitate the manipulation of the gripper within said densely packed array of tubes.

2. The tube gripper of claim 1, wherein said latch includes a hook member and a pin member, and wherein said pin member may be disengaged from said hook member by rotating said suspension member when the weight of said collet assembly is borne by the open end of said tube.

3. The tube gripper of claim 2, wherein said hook member is attached to said stop collar and said pin member is attached to said suspension member.

4. The tube gripper of claim 1, wherein said expander and said collet assembly are slidably engaged so that said expander may be slid into said expandable collet.

5. The tube gripper of claim 1, wherein said expander includes a tapered expansion member connected to said suspension member by means of a rod.

6. The tube gripper of claim 5, wherein said collet assembly includes a bore which extends from the mouth of said expandable collet to the other end of said collet assembly, and wherein said rod of said expander extends through said bore.

7. The tube gripper of claim 1, further including an extension means for extending the length of said suspension member.

8. The tube gripper of claim 7, wherein said extension means includes a plurality of mutually connectable extension members, whereby the length of said extension means may be adjusted.

9. The tube gripper of claim 7, wherein said extension means includes a threaded rod.

10. The tube gripper of claim 8, wherein said plurality of extension members are mutually connectable in tandem by means of threaded joints.

11. The tube gripper of claim 1, wherein said suspension member terminates in an eyelet.

12. The tube gripper of claim 1, wherein said expandable collet includes a plurality of resilient fingers having barbed threads for grippingly engaging the inside walls of said tube.

13. A gravity operated tube gripper for releasably gripping the inner walls of a single tube which is substantially vertically oriented within a closely packed array of tubes, comprising:

(a) a gripping means which is insertable within a tube when said gripper is lowered into an upper open end of the tube from a position thereabove including a collet assembly having an expandable collet at one end which is insertable within a tube, and a collet expander which is slidably engaged to said collet assembly which includes a tapered expansion member for selectively engaging and expanding the expandable collet when said tapered expansion member is forcefully engaged into the mouth of the expandable collet;

(b) a substantially rigid suspension member having a distal end, and a proximal end connected to said expander and detachably connected to said collet assembly for remotely lowering and inserting said expandable collet of said collet assembly into the open end of a tube, and for suspending the mouth of said expandable collet over the tapered expansion member of said expander, and (c) a stop collar circumscribing said collet assembly at the end opposite said expandable collet for limiting the depth to which the expandable collet may be inserted within said tube, and for seating said collet assembly of said gripper on the open end of the tube so that said tube end bears the weight of the collet assembly, and (d) a latch means including a disengageable pin member and hook member, said latch means being rotatably and remotely operable by rotating the distal end of said suspension member when the weight of the collet assembly is borne by the end of the tube through said stop collar, wherein said latch means selectively detaches said collet assembly from said suspension member so that the weight of said collet assembly causes the tapered expansion member to forcefully engage the mouth of the expandable collet and to expand the expandable collet into gripping contact with the inner walls of said tube solely as a result of the force of gravity acting upon the collet assembly, wherein the maximum cross sectional area of said tube gripper is only slightly in excess of the outer diameter of said tube in order to facilitate the manipulation of the gripper within said array of tubes, and wherein the pin member of the latch means becomes disengaged from the hook member when the weight of the collet assembly is borne by the open end of the tube, whereupon the pin member may be rotated out of alignment with the hook member by rotating the suspension member so that the pin member and hook member will not re-engage when the collet assembly is lifted off the tube end.

14. The tube gripper of claim 13, wherein said hook member is attached to said collar, and said pin member is attached to said suspension member.

15. The tube gripper of claim 13, wherein said collet assembly includes a bore which extends from the mouth of said expandable collet through said collar, and wherein said tapered expansion member of the expander is slidably engaged to said collet assembly by means of a rod connected between said tapered expansion member and said suspension member which slidably extends through said bore.

16. The tube gripper of claim 7, further including an extension means for extending the length of said suspension member.

17. The tube gripper of claim 16, wherein said extension means includes a plurality of mutually connectable extension members, whereby the length of said extension means may be adjusted.

18. The tube gripper of claim 16, wherein said extension means includes a threaded rod.

19. The tube gripper of claim 17, wherein said plurality of extension members are mutually connectable in tandem by means of threaded joints.

20. The tube gripper of claim 16, wherein said extension means terminates in an eyelet.

* * * * *